US011882892B2

(12) United States Patent
Kanazawa et al.

(10) Patent No.: US 11,882,892 B2
(45) Date of Patent: Jan. 30, 2024

(54) BUTTON FASTENER-SIDE DIE FOR ATTACHING SNAP BUTTON

(71) Applicant: YKK Corporation, Tokyo (JP)

(72) Inventors: Hiroaki Kanazawa, Tokyo (JP); Ryusaku Watanabe, Tokyo (JP)

(73) Assignee: YKK Corporation, Tokyo (JP)

( * ) Notice: Subject to any disclaimer, the term of this patent is extended or adjusted under 35 U.S.C. 154(b) by 507 days.

(21) Appl. No.: 16/340,302

(22) PCT Filed: Oct. 11, 2016

(86) PCT No.: PCT/JP2016/080152
§ 371 (c)(1),
(2) Date: Apr. 8, 2019

(87) PCT Pub. No.: WO2018/069983
PCT Pub. Date: Apr. 19, 2018

(65) Prior Publication Data

US 2019/0307195 A1 Oct. 10, 2019

(51) Int. Cl.
*A41H 37/04* (2006.01)
*A44B 17/00* (2006.01)

(52) U.S. Cl.
CPC ..... *A41H 37/04* (2013.01); *A44B 17/0011* (2013.01)

(58) Field of Classification Search
CPC .... A41H 37/04; A41H 37/00; A44B 17/0011; A44B 17/007; A44B 11/258; A43D 100/02; Y10T 24/3655
See application file for complete search history.

(56) References Cited

U.S. PATENT DOCUMENTS 2,310,008 A * 2/1943 Wolff ..... A41H 37/04 227/152
3,013,271 A * 12/1961 Carpinella ..... A41H 37/04 227/15
3,013,272 A * 12/1961 Barratt ..... A41H 37/04 227/140

(Continued)

FOREIGN PATENT DOCUMENTS

CN 104703494 A 6/2015
CN 106579621 A 4/2017

(Continued)

OTHER PUBLICATIONS

Office Action, Chinese Patent Application No. 201680089511.2, dated May 8, 2020.

(Continued)

*Primary Examiner* — Anna K Kinsaul
*Assistant Examiner* — Luis G Del Valle
(74) *Attorney, Agent, or Firm* — Kilpatrick Townsend & Stockton LLP

(57) ABSTRACT

Provided is a button fastener-side die. The button fastener comprises an annular base defining an opening and a plurality of legs. The button fastener-side die includes a holding part for holding the button fastener and a correcting member for passing through the opening of the button fastener held by the holding part, a pushing member for pushing the correcting member to move in a passing direction toward passing through the opening of the button fastener, and a first spring disposed between the correcting member and the pushing member. When at least one of the legs of the button fastener is in an abnormal position, the correcting member corrects the abnormal leg(s) to be in the normal position as the correcting member is passing through the opening.

12 Claims, 14 Drawing Sheets

(56) References Cited

U.S. PATENT DOCUMENTS

| | | | | | |
|---|---|---|---|---|---|
| 3,992,765 | A | | 11/1976 | Silverbush et al. | |
| 4,436,238 | A | * | 3/1984 | Seki | A41H 37/10 227/15 |
| 5,263,627 | A | * | 11/1993 | Breuer | A41H 37/00 227/18 |
| 5,781,989 | A | * | 7/1998 | Schmidt | A41H 37/00 227/18 |
| 2011/0302758 | A1 | * | 12/2011 | Ishii | A41H 37/04 29/700 |
| 2015/0007412 | A1 | * | 1/2015 | Neuron | A44B 13/0094 156/583.1 |
| 2017/0105492 | A1 | * | 4/2017 | Wetzel | A41H 37/02 |

FOREIGN PATENT DOCUMENTS

| | | | | | |
|---|---|---|---|---|---|
| DE | 594541 | C | * | 3/1934 | A43D 100/02 |
| DE | 631733 | C | * | 6/1936 | A43D 100/02 |
| JP | 58-23909 | A | | 2/1983 | |
| JP | 2010-096330 | A | | 4/2010 | |
| TW | 201424614 | A | | 7/2014 | |
| WO | WO-2013150644 | A1 | * | 10/2013 | A41H 37/10 |
| WO | 2014/049881 | A1 | | 4/2014 | |
| WO | 2014/061140 | A1 | | 4/2014 | |
| WO | 2014/097483 | A1 | | 6/2014 | |
| WO | WO-2014097483 | A1 | * | 6/2014 | A41H 37/04 |

OTHER PUBLICATIONS

International Preliminary Report on Patentability, PCT Patent Application No. PCT/JP2016/080152, dated Apr. 25, 2019.

International Search Report, PCT Patent Application No. PCT/JP2016/080152, dated Dec. 27, 2016.

Office Action, Taiwanese Patent Application No. 106111964, dated Nov. 17, 2017.

* cited by examiner

BUTTON FASTENER-SIDE DIE FOR ATTACHING SNAP BUTTON

TECHNICAL FIELD

The present invention relates to a button fastener-die for attaching a snap button and a method for correcting legs of a button fastener, and more specifically to a die on which a button fastener is set when a snap button is attached to a fabric such as fabrices and a method for correcting a radially inward bend of one or more legs of the button fastener. The snap button comprising a snap member as a male snap or a female snap and the button fastener having a plurality of the legs.

BACKGROUND ART

Snap buttons are widely used for baby clothes and the like, for example. A snap button comprises a male or female snap (snap member) and a button fastener, and a pair of the male and female snaps are engaged with and disengaged from each other. FIG. 1 is a cross-sectional view showing a state immediately before a female snap 10 as a snap member is attached to a fabric 1 such as baby clothes or the like using a metal button fastener 20 having a plurality of legs 22. FIG. 2 is a cross-sectional view showing a state where the female snap 10 is attached to the fabric 1. The female snap 10 is formed such as by drawing a metal plate, and includes a central cylindrical portion 11 and a flange 14 extending radially outward from the lower end of the central cylindrical portion 11 (As to the female snap 10 and the button fastener 20, lower and upper directions are based on FIGS. 1 to 4). The central cylindrical portion 11 detachably receives and engages an engaging projection of a male snap (not shown). The central cylindrical portion 11 includes an inner bulge 12 folded back radially inward from the top, and a plurality of slits 13. The plurality of the slits 13 are arranged in the circumferential direction of the central cylindrical portion 11. Each of the plurality of the slits 13 is formed from the top of the inner bulge 12 to a lower point of the central cylindrical portion 11. The flange 14 extends radially outward and upward from the lower end of the central cylindrical portion 11 and then is bent downward and radially inward in a C shape to terminate. There is an annular clearance 15 between the terminated end 14*a* of the flange 14 and a radially inner flange portion 14*b* (a proximal end portion 14*b* connected to the lower end of the central cylindrical portion 11 in the flange 14). This clearance 15 is a leg receiving opening 15 for receiving, inside the flange 14, the legs 22 of the button fastener 20 that have penetrated the fabric 1, as will be described later.

The button fastener 20 is formed such as by drawing a metal plate and the like, and comprises an annular base 21 and five legs 22, for example, which continuously rise upward from the radially inner end of the base 21. The base 21 defines a circular opening 23. Each of the legs 22 extends from the base 21 to the top 22*a* as its width gradually narrows, making the top 22*a* sharp. When the female snap 10 is to be attached to the fabric 1, generally, the female snap 10 is held by an upper die 30; the button fastener 20 is set on a lower die (button fastener-side die) 40; and the fabric 1 is placed above the button fastener 20. Then, the upper die 30 is lowered toward the lower die 40. Thereby, each of the legs 22 of the button fastener 20 penetrates the fabric 1 upward, then enters the inside of the flange 14 through the leg receiving opening 15 of the female snap 10. Then, the legs 22 are swaged along the inner surface of the flange 14 in a curved manner as shown in FIG. 2. Thereby, the female snap 10 is fixed on the fabric 1. FIG. 2 shows a state where the female snap 10 is normally attached to the fabric 1. Although not shown, a male snap also includes the same flange as in the female snap 10. That is, the male snap also has a flange 14 having a leg receiving opening 15. Therefore, the male snap is also attached to a fabric using the same button fastener 20.

Especially in baby clothes, if a snap button is not properly attached due to some cause, a baby's skin might be hurt, so it is necessary to make every effort to prevent such a defective attachment from occurring. One example in which a snap button is not normally attached may occur is, as shown in FIG. 3, that when one or more legs 22*b* of the button fastener 20 are bent radially inward relative to the normal position as shown in FIG. 1. In this case, at attaching the female snap 10 to the fabric 1, such legs 22*b* do not enter into the flange 14 through the leg receiving hole 15 after penetrating the fabric 1 upward (or without penetrating the fabric 1), as shown in FIG. 4 where one leg 22*b* is bent down radially inward beyond the lower end of the central cylindrical portion 11 to the center of the female snap 10.

SUMMARY OF INVENTION

Technical Problem

An object of the present invention is to provide a button fastener-side die for attaching a snap button to a fabric and a method for correcting one or more legs of a button fastener, and the die and the method can properly attach a snap button to a fabric even when one or more legs of a button fastener are bent radially inward from the normal position as mentioned above.

Solution to Problem

To solve the above problem, according to one aspect of the present invention, there is provided a button fastener-side die for attaching a snap button, on which a button fastener is to be set when a snap member is attached to a fabric with the button fastener, the button fastener comprising an annular base defining an opening and a plurality of legs extending from the base, the button fastener-side die comprising: a holding part for holding the button fastener and a correcting member for passing through the opening of the base of the button fastener held by the holding part, a pushing member for pushing the correcting member to move in a passing direction toward passing through the opening of the base of the button fastener, and a first spring disposed between the correcting member and the pushing member, wherein when at least one of the legs of the button fastener is in an abnormal position bent radially inward from a normal position, the correcting member corrects the leg(s) in the abnormal position to be in the normal position as the correcting member is passing through the opening of the button fastener, and wherein when the pushing member is in its forefront position in the passing direction, the correcting member reaches its forefront position in the passing direction, by the first spring, where the correcting member is allowed to come into contact with the fabric.

In the button fastener-side die for attaching a snap button according to the present invention, the correcting member pushes the correcting member in the passing direction to pass it through the opening of the base of the button fastener, so that leg(s) in the abnormal position can be corrected to be in the abnormal position. That is, the leg(s) in the abnormal position is corrected radially outward by the correcting member.

Further, in the present invention, when the pushing member reaches its forefront position in the passing direction, the correcting member reaches its forefront position in the passing direction in which the correcting member can contact the fabric by the first spring. In this regard, the following explanations will be given separately for a case (i) where all the legs of the button fastener are not in the abnormal position and for a case (ii) where at least one leg of the button fastener is in the abnormal position. In the case (i), the pushing member passes the correcting member through the opening of the button fastener via the first spring, and the correcting member reaches its forefront position at the same time as the pushing member reaches its forefront position in the passing direction. In the forefront position (the uppermost position in FIG. 12), the correcting member can contact the fabric 1, and, in other words, there is no clearance between the tip of the correcting member and the fabric. In the case (ii), when the pushing member pushes the correcting member in the passing direction via the first spring, the correcting member contacts the leg(s) in the abnormal position of the button fastener and receives a resistance therefrom. Due to this resistance, the correcting member temporarily stops moving in the passing direction or its moving speed decreases. Thereby, the first spring is temporarily compressed. Then, when the pushing member reaches its forefront position in the passing direction, the correcting member passes through the opening of the button fastener (see FIG. 10). Thereby, the leg(s) in the abnormal position of the button fastener is corrected to be in the normal position, and accordingly the compressed first spring is restored and moves the correcting member up to the same forefront position as in the case (i) (See FIGS. 11 and 12). The correcting member contacts the fabric 1 at its forefront position, and there is no clearance between the tip of the correcting member and the fabric. This makes it possible to prevent the corrected leg(s) form returning toward the radially inward, abnormal position by spring back.

In one embodiment of the present invention, the correcting member has a first spring receiving portion for receiving one end side of the first spring, and the pushing member has a second spring receiving portion for receiving the other end side of the first spring, wherein when the correcting member is in an unloaded state where the correcting member is not subjected to a force in a direction opposite to the passing direction, the first spring is in an initial state of most extension in the passing direction, and a gap exists between the correcting member and the pushing member. Here, "an unloaded state where the correcting member is not subjected to a force in a direction opposite to the passing direction" means a state where the correcting member is not subjected to a resistance that may prevent a movement in the passing direction or a force in the direction opposite to the passing direction. For example, when the correcting member is not receiving a resistance by contacting a leg in the abnormal position of the button fastener or is not receiving a force, in the direction opposite to the passing direction, from the upper die side at swaging of the button fastener, the correcting member is in the unloaded state. In the unloaded state of the correcting member, the first spring is in the initial state where it extends most in the passing direction, and there is a gap between the correcting member and the pushing member. When the correcting member receives a resistance or a force in the direction opposite to the passing direction, the first spring is compressed in the passing direction from the initial state between the correcting member and the pushing member, and accordingly the gap between the correcting member and the pushing member is also reduced in the passing direction.

In one embodiment of the present invention, when the correcting member comes into contact with the leg(s) in the abnormal position, the correcting member temporarily stops moving in the passing direction or its moving speed decreases, whereby the first spring is compressed in the passing direction and the gap shrinks. When the correcting member contacts the leg(s) in the abnormal position, a resistance is caused therefrom, and thereby the movement thereof in the passing direction temporarily stops or the moving speed decreases by the resistance. On the other hand, the pushing member continues to move in the passing direction, the first spring is compressed from the initial state between the correcting member and the pushing member, and the gap between the correcting member and the pushing member is also reduced.

In one embodiment of the present invention, when the first spring reaches the most compressed state as most compressed in the passing direction, the pushing member pushes the correcting member which is temporarily stopped to force it to move in the passing direction so as to pass through the opening of the button fastener. When the correcting member contacts the leg(s) in the abnormal position of the button fastener and temporarily stops moving in the passing direction, the first spring is compressed between the correcting member and the pushing member continuously moving. When the first spring is most compressed (the most compressed state), the pushing member that continues to move in the passing direction forces the correcting member to move in the passing direction via the first spring in the most compressed state. Thereby, the temporary stopped state of the correcting member is released; the correcting member passes through the opening of the button fastener; and the correcting member corrects the leg(s) in the abnormal position to be in the normal position. The most compressed state as to the first spring includes the following cases. One is a case where the first spring itself is in a state where it cannot be further compressed. Another one is a case where the one end side of the first spring is received in the first spring receiving portion of the correcting member and the other end side of the first spring is received in the second spring receiving portion of the pushing member, and when the correcting member and the pushing member contact each other, there is no room for the first spring to be compressed further.

In an embodiment of the present invention, in the most compressed state of the first spring, the gap disappears and the pushing member comes into contact with the correcting member. In this case, when the correcting member temporarily stops by contacting the leg(s) in the abnormal position of the button fastener, the first spring assumes the most compressed state. At this time, the correcting member and the pushing member contacts each other and the gap between then disappears. Thereby, the pushing member pushes the correcting member directly in the passing direction and passes it through the opening of the button fastener.

In an embodiment of the present invention, the button fastener-side die comprises a supporting member, which moves in the passing direction in order to release the holding of the button fastener by the holding part and supports the button fastener when the legs of the button fastener are swaged. The supporting member engages with the holding part while moving in the passing direction to release the button fastener from the holding part. The supporting member also supports the button fastener when the legs thereof are being swaged in order to attach the snap member to the fabric with the snap member-side die. The release of the button fastener from the holding part is performed substantially simultaneously with passing of the correcting member through the opening of the button fastener.

In an embodiment of the present invention, the supporting member is a cylindrical member, and the correcting member and the pushing member are disposed at least partially inside the supporting member. The supporting member can engage with the holding part by an annular upper end surface of the cylindrical member, supporting member to release the button fastener from the holding part, and can support the button fastener on the annular upper end surface at the swaging.

In one embodiment of the present invention, the holding part comprises a pair of holding members and an elastic member for biasing the pair of the holding members in a direction to approach each other, and wherein each of the holding members has an inclined surface, and the holding members are displaced in a direction away from each other against the biasing of the elastic member by the supporting member contacting the inclined surface. The supporting member contacts the inclined surfaces of the pair of the holding members while moving in the passing direction, so that the supporting member displaces the pair of the holding members in a direction away from each other against the biasing of the elastic member. Thereby, the button fastener is released from the holding part.

In one embodiment of the present invention, the button fastener-side die comprises a rear member for moving the pushing member in the passing direction and a stopper for restricting the moving of the rear member in the passing direction at the time when the correcting member can reach the forefront position thereof. The pushing member moves in the passing direction by the rear member and pushes the correcting member in the passing direction. When the movement of the rear member in the passing direction is restricted by the stopper, the pushing member stops and, at this time, the correcting member reaches its forefront position in the passing direction.

In one embodiment of the present invention, the button fastener-side die comprises a plunger for moving the supporting member in the passing direction. The can reciprocate between the bottom dead center and the top dead center. At the top dead center of the plunger, the supporting member reaches the forefront position in the passing direction and supports the button fastener at the swaging.

In an embodiment of the present invention, the plunger moves the rear member in the passing direction via a second spring.

According to another aspect of the present invention, there is provided a method for correcting one or more legs in an abnormal position when a snap member is attached to a fabric with a button fastener which comprises an annular base defining an opening and a plurality of legs extending from the base, and when at least one of the legs of the button fastener is in the abnormal position bent radially inward from a normal position, comprising: holding the button fastener by a holding part; and pushing a correcting member to move in a passing direction toward passing through the opening of the base of the button fastener by a pushing member, wherein when at least one of the legs of the button fastener is in the abnormal position bent radially inward from the normal position, the correcting member corrects the leg(s) in the abnormal position to be in the normal position as the correcting member is passing through the opening of the button fastener.

In one embodiment of the present invention, the method comprises stopping temporarily the moving of the correcting member in the passing direction or decreasing the moving speed of the correcting member and compressing the first spring in the passing direction when the correcting member comes into contact with the leg(s) in the abnormal position, and pushing the correcting member which is temporarily stopped by the pushing member to force the correcting member to move in the passing direction so as to pass through the opening of the button fastener when the first spring reaches the most compressed state a most compressed in the passing direction.

In one embodiment of the present invention, in the most compressed state of the first spring, the pushing member comes into contact with the correcting member. In this case, the pushing member directly moves the correcting member in the passing direction to pass through the opening of the button fastener.

In one embodiment of the present invention, the method includes making the correcting member reach the forefront position thereof in the passing direction, by the first spring being restored from the most compressed state, where the correcting member is allowed to come into contact with the fabric. The correcting member at the forefront position contacts the fabric and therefore there is no clearance between the tip of the correcting member and the fabric. Thereby, it is possible to prevent the leg(s) corrected to be in the normal position from returning toward radially inward by spring back.

Advantageous Effect of Invention

In the present invention, when one or more legs of the button fastener are in the abnormal position as bent radially inward from the normal position, it is possible to correct the leg(s) in the abnormal position to be in the normal position by passing the correcting member through the opening of the base of the button fastener while the correcting member is pushed in the passing direction by the pushing member. When the pushing member reaches its forefront position in the passing direction, the correcting member reaches its forefront position in the passing direction in which the correcting member can contact the fabric via the first spring. This makes it possible to prevent the legs(s) corrected to be in the normal position of the button fastener from returning radially inward by the spring back.

DESCRIPTION OF EMBODIMENTS

Hereinafter, an embodiments of the present invention will be described with reference to the drawings. However, the present invention is not limited to such an embodiment, and modifications and the like may be made within the scope of the claims and the range of equivalents.

Figure 1:
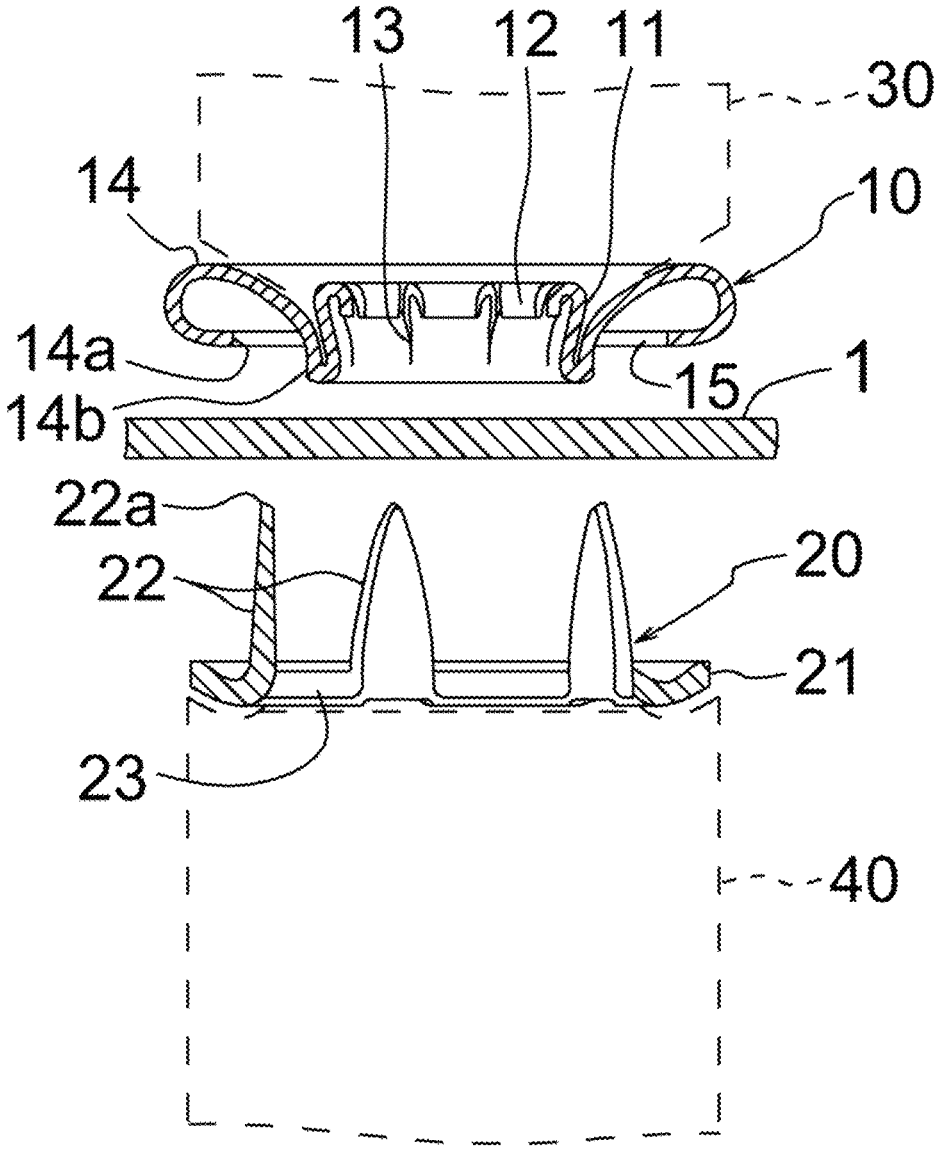
FIG. 1 is a cross-sectional view showing a female snap and a button fastener immediately before they are attached to a fabric.
Figure 5:
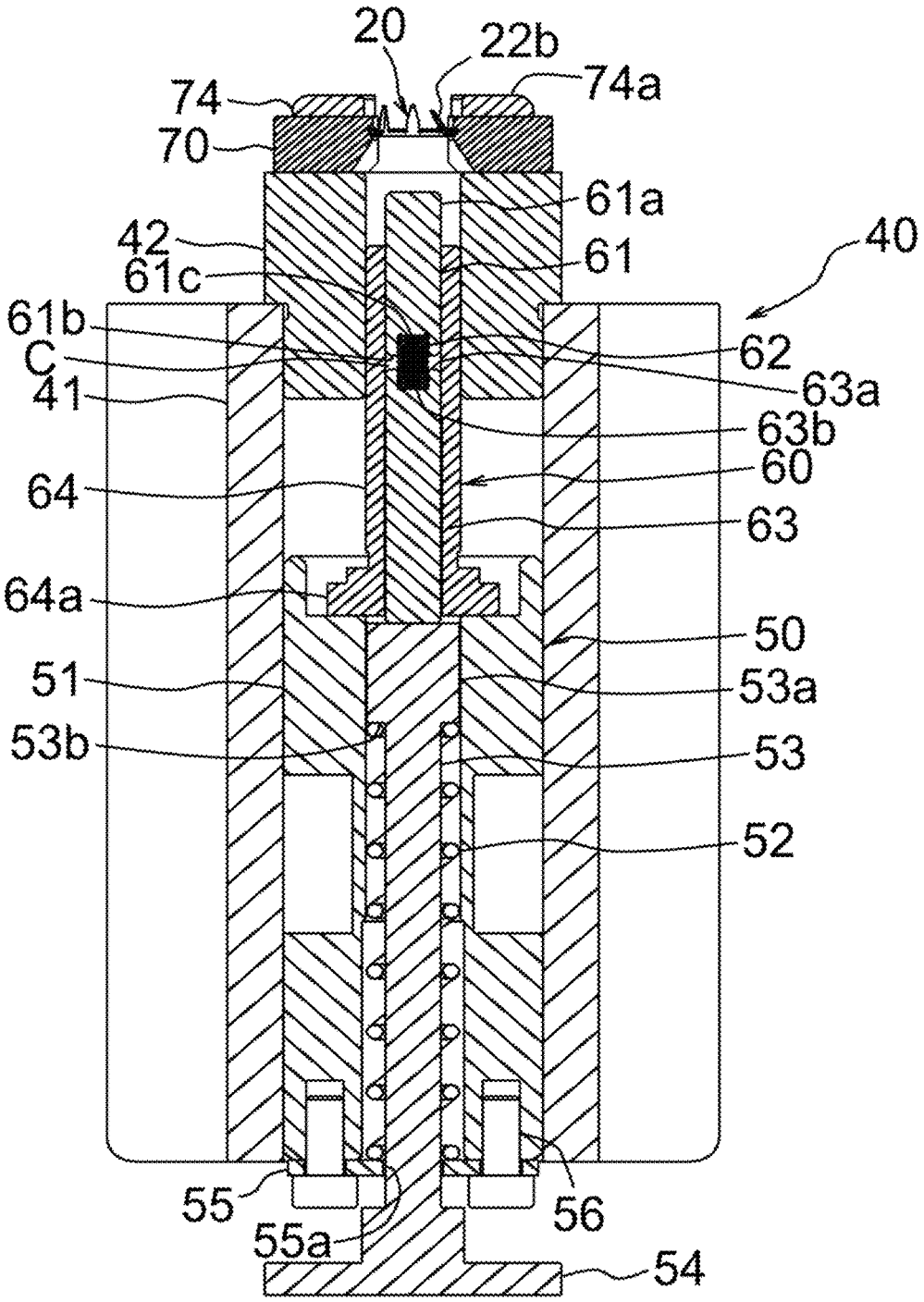
FIG. 5 is a cross-sectional view showing a lower die for attaching a snap button as a button fastener-side die in accordance with an embodiment of the present invention, wherein an upper and a lower structure bodies of the die are in the lowermost, initial position.

FIG. 5 is a cross-sectional view of a lower die 40 as a button fastener-side for attaching a snap button, according to an embodiment of the present invention. In FIG. 5, upper and lower structure bodies 60, 50 as described later of the lower die 40 are at their lowermost initial positions, and a button fastener 20 is held by a holding part 70 as described later. A female snap 10 or a male snap, which is attached to the fabric 1 together with the button fastener 20 is held by an upper die 30 (see FIGS. 1, 13, etc.). Hereinafter, an up-and-down (vertical) direction is based on FIGS. 5 to 14.

The lower die 40 comprises a lower structure body 50, an upper structure body 60, a cylindrical upper guide 42 and a holding part 70 for holding the button fastener 20. The lower structure body 50 includes a cylindrical housing frame 41 and a plunger 51 housed in the housing frame 41 movably in the vertical direction. The upper structure body 60 is raised upward (in the "passing direction" in the claims) by the lower structure body 50. The upper guide 42 is coupled to an upper opening of the housing frame 41 and guides the upper structure 60 to move upward. The holding part 70 is mounted on the upper surface of the upper guide 42. The housing frame 41 and the upper guide 42 are stationary structures which do not move in the vertical direction.

The upper structure 60 includes an elongated columnar correcting pin 61 as a correcting member, a cylindrical or coiled first spring 62, an elongated columnar pushing pin 63 as a pushing member, and a cylindrical supporting member 64. An upper end portion 61*a* of the correcting pin 61 can be passed through the opening 23 (see FIG. 1) of the base 21 of the button fastener 20. The pushing pin 63 is arranged under the first spring 62, and can push upward the correcting pin 61 via the first spring 62. The supporting member 64 surrounds the correcting pin 61 except for its upper end side, the first spring 62 and the pushing pin 63. In the initial position of FIG. 5, the correcting pin 61 is disposed in the lumen of the supporting member 64 except for its upper portion, and the pushing pin 63 is disposed in the lumen except for a slight portion at its lower end. The correcting pin 61, the first spring 62, the pushing pin 63, the housing frame 41, the plunger 51, etc. have a common axis. Hereinafter, the direction along this axis is referred to as the axial direction, and in the present embodiment, the axial direction is synonymous with the vertical direction. Further, any plane perpendicular to that axis is referred to as the horizontal. In the initial position of FIG. 5, the upper end surface of the correcting pin 61 is slightly lower than the upper end surface of the upper guide 42. The correcting pin 61 has an upper spring receiving portion 61*c* as a first spring receiving portion, which is recessed upward in a columnar shape from its lower end surface 61*b*. The pushing pin 63 has a lower spring receiving portion 63*b* as a second spring receiving portion, which is recessed downward from the upper end surface 63*a* in a columnar shape. An upper portion of the first spring 62 is received in the upper spring receiving portion 61*c* of the correcting pin 61, and a lower portion is received in the lower spring receiving portion 63*b* of the pushing pin 63. In the initial position of FIG. 5, the first spring 62 is in its initial state where it extends most in the vertical direction (axial direction), and there is a gap C between the lower end surface 61*b* of the correcting pin 61 and the upper end surface 63*a* of the pushing pin 63. The first spring 62 maintains the initial state in an unloaded state where the correcting pin 61 is not subjected to a force in the reverse direction (downward) opposite to the passing direction (upward), and the vertical length of the gap C becomes maximum.

The correcting pin 61 and the pushing pin 63 have the same outer diameter, and this outer diameter is slightly smaller than the diameter of the opening 23 of the base 21 of the button fastener 20. More specifically, when all of the legs 22 of the button fastener 20 are not in an abnormal position, the upper end portion 61*a* of the correcting pin 61 can pass through the opening 23 of the button fastener 20 without coming into contact with the button fastener 20. On the other hand, when one or more legs 22 of the button fastener 20 are in the abnormal position, as the upper end portion 61*a* of the correcting pin 61 is passing through the opening 23 of the button fastener 20 upwardly, the outer peripheral surface of the upper end portion 61*a* contacts the leg(s) 22*b* (see FIG. 9, etc.) in the abnormal position so as to straighten or correct the leg(s) 22*b* to be in the normal position (see FIG. 10). In other words, the leg (b) 22*b* in the abnormal position is forced to be set right radially outward by the correcting pin 61. Even after this correction, the upper end portion 61*a* of the correcting pin 61 continues contacting the leg(s) (22*c* as described later) corrected in the normal position, and with friction by the contacting, the button fastener 20 moves upward together with the upper end portion 61*a* (see FIG. 11, etc.). The inner diameter of the supporting member 64 is substantially the same as the diameter of the opening 23 of the base 21 of the button fastener 20, and is slightly larger than the outer diameters of the correcting pin 61 and the pushing pin 63. The outer diameter of the supporting member 64 is slightly smaller than the inner diameter of the upper guide 42.

The pushing pin 63 moves upward by being lifted by the lower structure body 50 and pushes up the correcting pin 61 via the first spring 62. The correcting pin 61 has the upper end portion 61*a* that passes upward through the opening 23 of the base 21 of the button fastener 20 held by the holding part 70 at attaching the snap button to the fabric 1. The upper end surface of the upper end part 61*a* is a circular surface along the horizontal. As described above, the outer diameter of the correcting pin 61 including the upper end portion 61*a* is set to be slightly smaller than the diameter of the opening 23 of the base 21 of the button fastener 20. Therefore, when all of the legs 22 of the button fastener 20 are in the normal position shown in FIG. 1 (and, when one or more legs 22 of the button fastener 20 are bent radially outward from the normal position, though not shown), the upper end portion 61*a* of the correcting pin 61 can pass through the opening 23 of the button fastener 20 without receiving resistance from the legs 22. On the other hand, when one or more legs 22 of the button fastener 20 are in the abnormal position as bent radially inward from the normal position (see the leg(s) 22*b* in FIG. 6, etc.), as the upper end portion 61*a* of the correcting pin 61 is passing through the opening 23 of the button fastener 20, the upper end of the upper end portion 61*a* comes into contact with the leg(s) 22*b* in the abnormal position (see FIG. 7), and this acts as a resistance against the correcting pin 61 trying to move upward. That is, one or more legs 22*b* in the abnormal position of the button fastener 20 contact the upper end of the upper end portion 61*a* of the correcting member 61 trying to move upward through the opening 23 of the button fastener 20, and temporarily block the passing of the upper end portion 61*a* through the opening 23. Thereby, the upward movement of the correcting pin 61 temporarily stops. Depending on a degree of radially inward bend of the leg(s) 22*b* in the abnormal position, even if the upper end portion 61*a* of the correcting member 61 comes into contact with the leg(s) 22*b* and receives a resistance, the upper end portion 61*a* will not stop but the moving speed of the upper end portion 61*a* through the opening 23 may decrease (compared with the upward moving speed of the pushing pin 63). However, hereinafter, an example will be described, in which the upward movement of the correcting pin 61 temporarily stops when the correcting pin 61 contacts the leg(b) 22*b* in the abnormal position of the button fastener 20 and receives a resistance.

Figure 7:
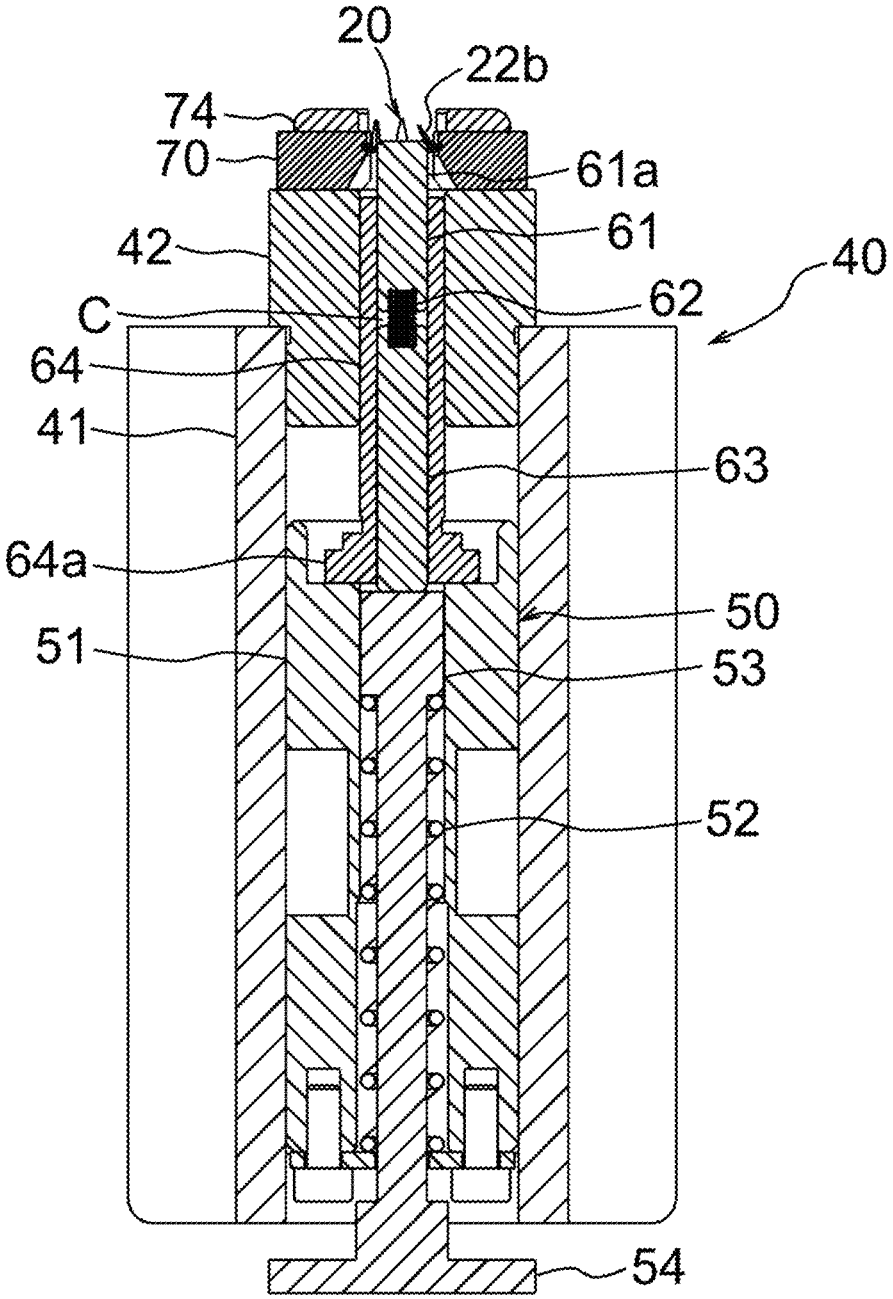
FIG. 7 is a cross-sectional view showing a time point when a correcting pin contacts the leg in the abnormal position of the button fastener and temporarily stops after the correcting pin moves upward from the initial position shown in FIG. 5.
Figure 8:
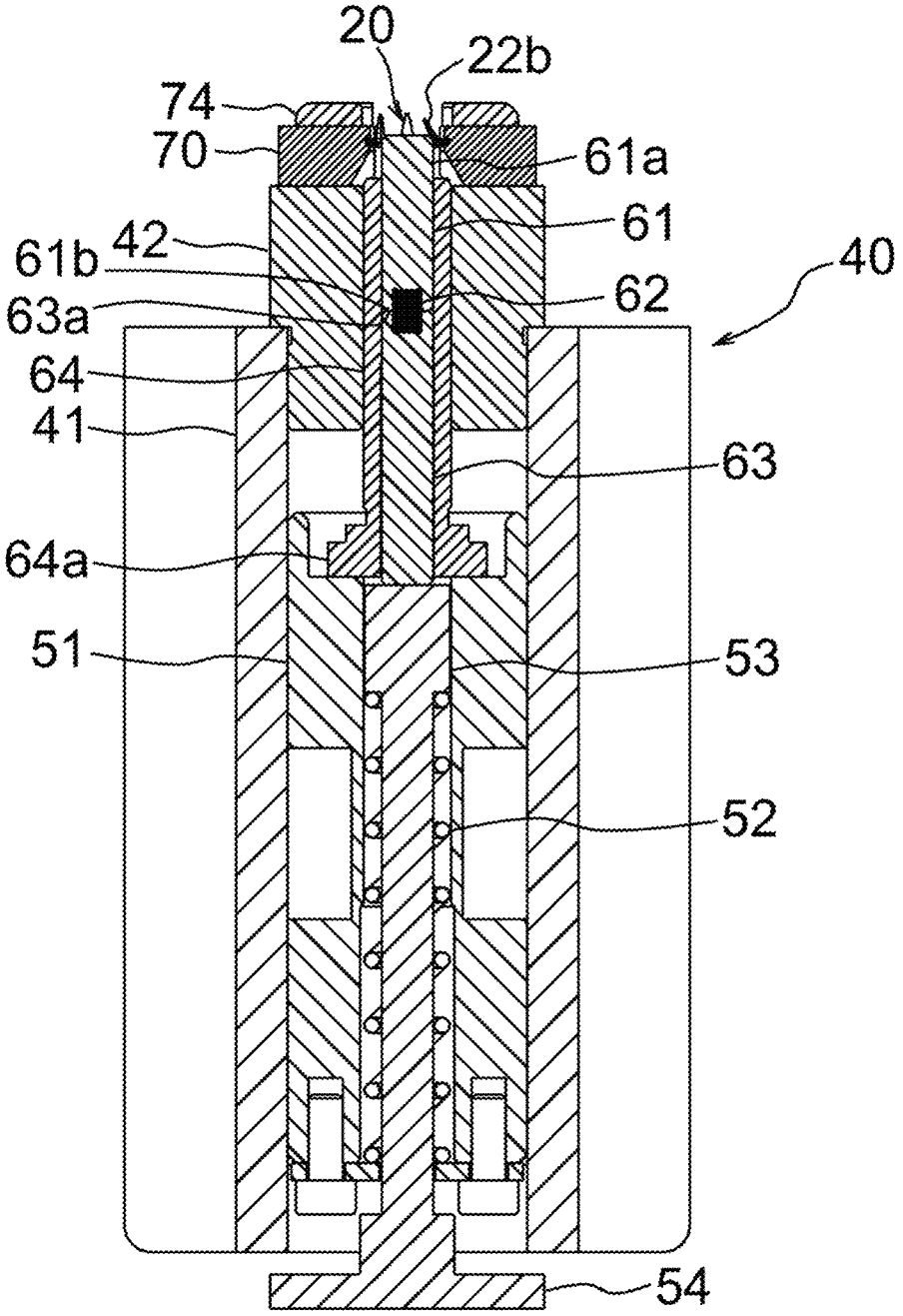
FIG. 8 is a cross-sectional view showing that the first spring is in the most compressed state by the pushing pin further moving upward from the time point of FIG. 7 and that a gap between the correcting pin and the pushing pin disappears.
Figure 10:
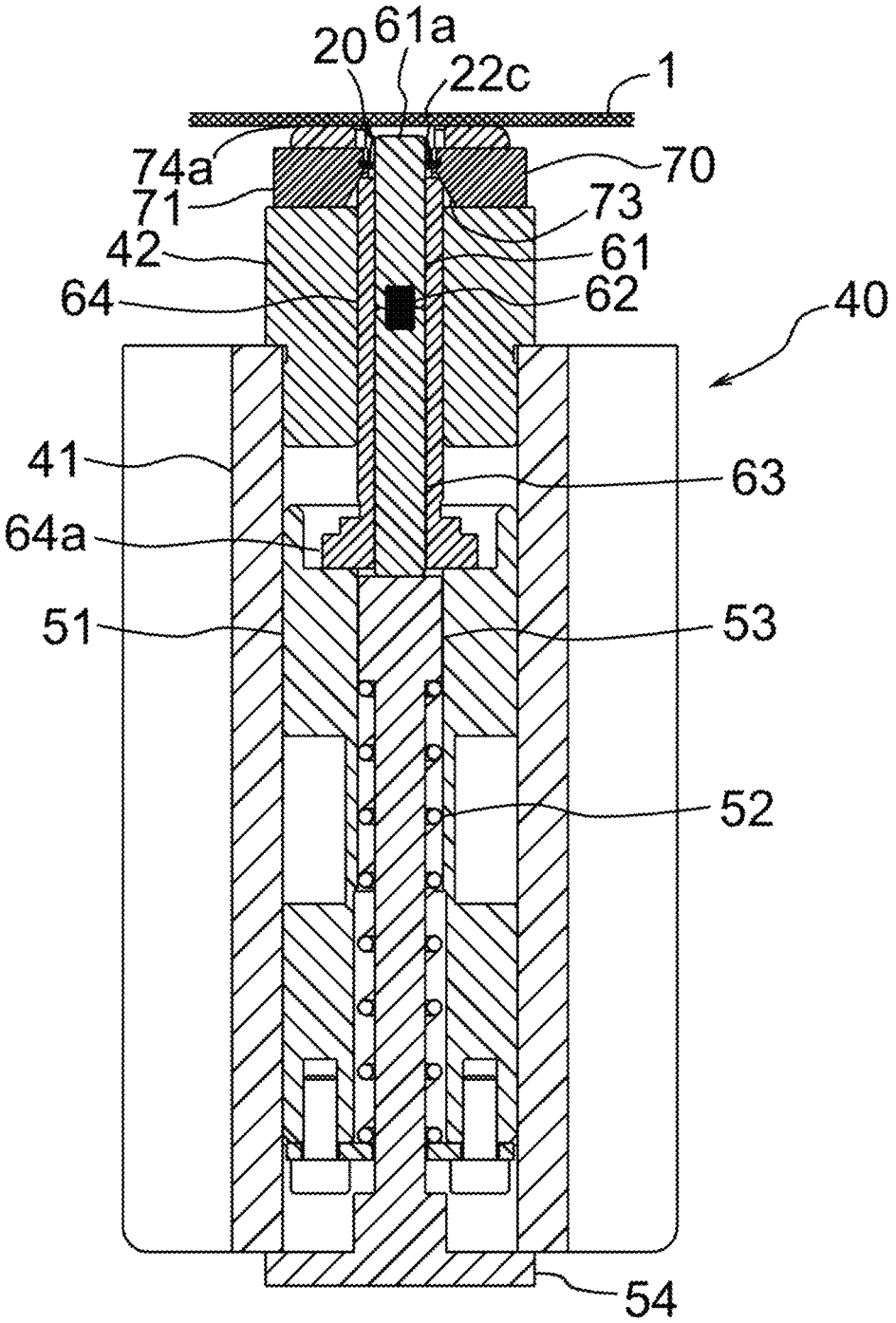
FIG. 10 is a cross-sectional view showing a state where the pushing pin forcibly pushes upward the correcting pin, and an upper end portion of the pushing pin is correcting the leg in the abnormal position while passing through the opening of the button fastener.
Figure 11:
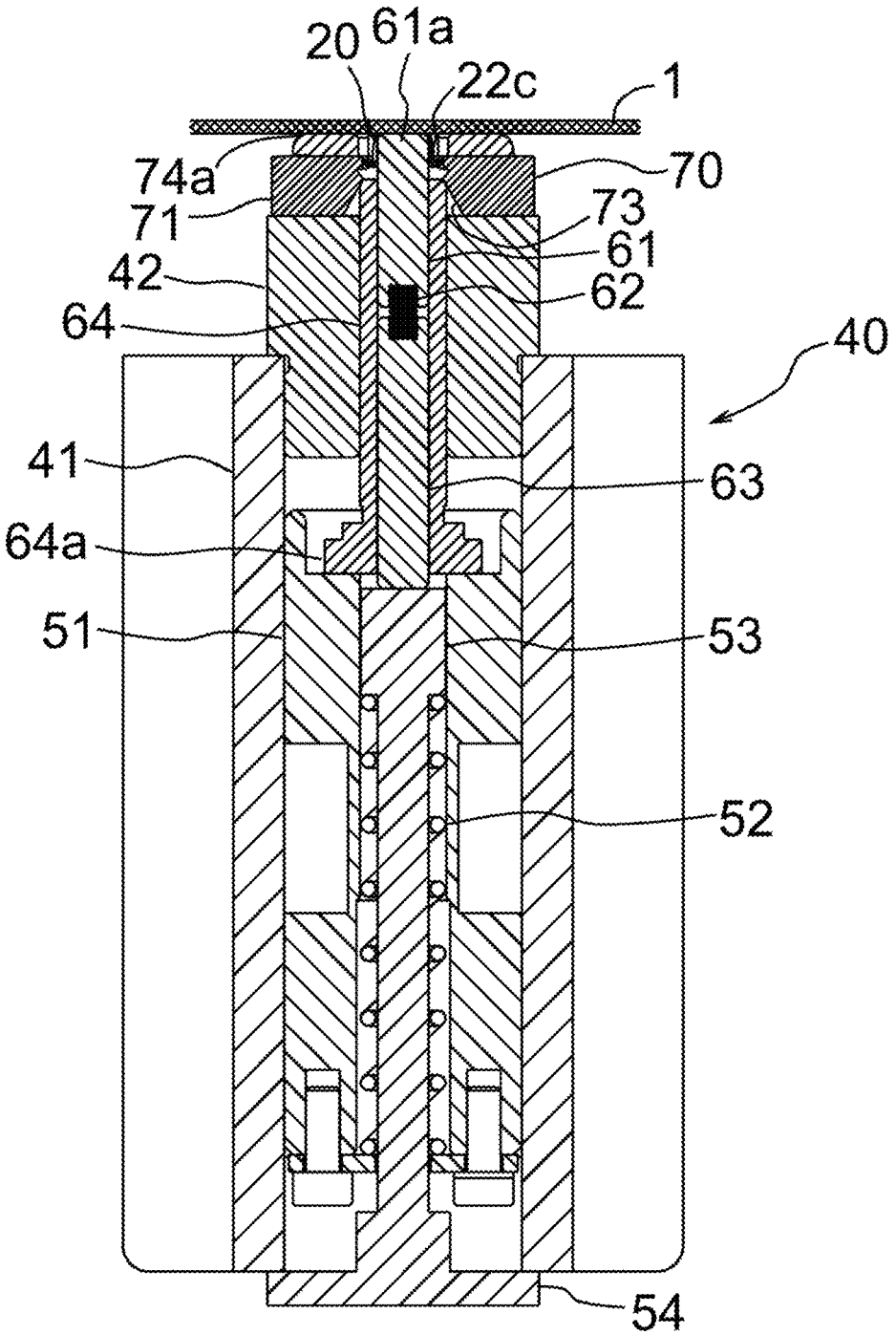
FIG. 11 is a cross-sectional view showing a state where the button fastener is released from the holding part by the upper end of a supporting member engaging with inclined surfaces of a pair of holding members and displacing the pair of the holding members away from each other, wherein the correcting pin is in its uppermost position.
Figure 12:
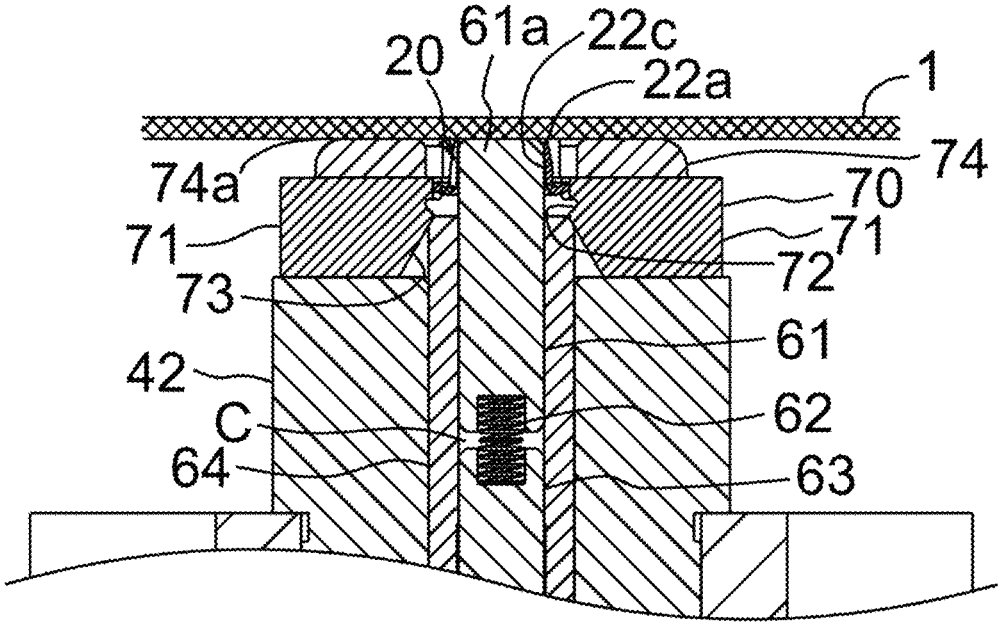
FIG. 12 is a partially enlarged sectional view in the vicinity of the button fastener of FIG. 11.

The pushing pin 63 pushes up the correcting pin 61 via the first spring 62. When all the legs 22 of the button fastener 20 held by the holding part 70 are not in the abnormal position, the correcting pin 61 and the pushing pin 63 with the first spring 62 between them move upward at substantially the same speed to the uppermost position (see FIG. 11), in which the upper end of the correcting pin 61 comes into contact with the fabric 1. In this case, the gap C between the correcting pin 61 and the pushing pin 63 hardly shrinks in the axial direction and remains substantially constant from the initial position of FIG. 5 to the uppermost position of FIG. 11. The pushing pin 63 can move upward to the position shown in FIG. 11 where a stopper 54 as will be described later comes into contact with the lower end of the housing frame 41 and a further rise of the pushing pin 63 is restricted. On the other hand, when one or more legs 22 of the button fastener 20 held by the holding part 70 are in the abnormal position as described above, the correcting pin 61 trying to pass through the opening 23 of the button fastener 20 contacts the leg(s) 22*b* in the abnormal position (See FIG. 7) and receives a resistance from the leg(s) 22*b*. Thereby, the upward movement of the correcting pin 61 is temporarily stopped. Even after the upward movement of the correcting pin 61 is temporarily stopped in this way, the pushing pin 63 continues to rise by being lifted by the lower structure body 50. Therefore, the first spring 62 is gradually compressed in the axial direction from the initial state between the correcting pin 61 in the temporarily stopped state and the pushing pin 63 moving upward, and the gap C between the lower end surface 61*b* of the correcting pin 61 and the upper end surface 63*a* of the pushing pin 63 gradually shrinks in the axial direction. That is, the first spring 62 is set to be compressed by the resistance that the correcting pin 61 receives from the leg(s) 22*b* in the abnormal position of the button fastener 20. Next, as shown in FIG. 8, the lower end surface 61*b* of the correcting pin 61 and the upper end surface 63*a* of the pushing pin 63 come into contact with each other, so that the first spring 62 becomes most compressed state and the gap C disappears. Here, the "most compressed state" of the first spring 62 means that the first spring 62 cannot be compressed any further because the correcting pin 61 and the pushing pin 63 contact each other. Thereby, the pushing pin 63 which is being raised continuously by the lower structure body 50 begins lifting the correcting pin 61 directly. Thereby, the correcting pin 61 is forced to move upward by the pushing pin 63, and as shown in FIG. 10, the upper end portion 61*a* passes through the opening 23 of the button fastener 20 against the resistance of the leg(s) 22*b* in the abnormal position. At this time, the upper end portion 61*a* of the correcting pin 61 corrects or straightens the leg (b) 22*b* in the abnormal position of the button fastener 20 to be in the normal position. In FIGS. 10 to 12, the leg(s) corrected from the abnormal position to the normal position are indicated by the reference numeral 22*c*. Further, as will be described later, after the leg(s) 22*b* in the abnormal position has been corrected by the upper end portion 61*a* of the correcting pin 61, the button fastener 20 is raised by friction with the upper end portion 61*a*, moving up together with the upper end portion 61*a* as shown in FIGS. 10 to 12.

Figure 6:
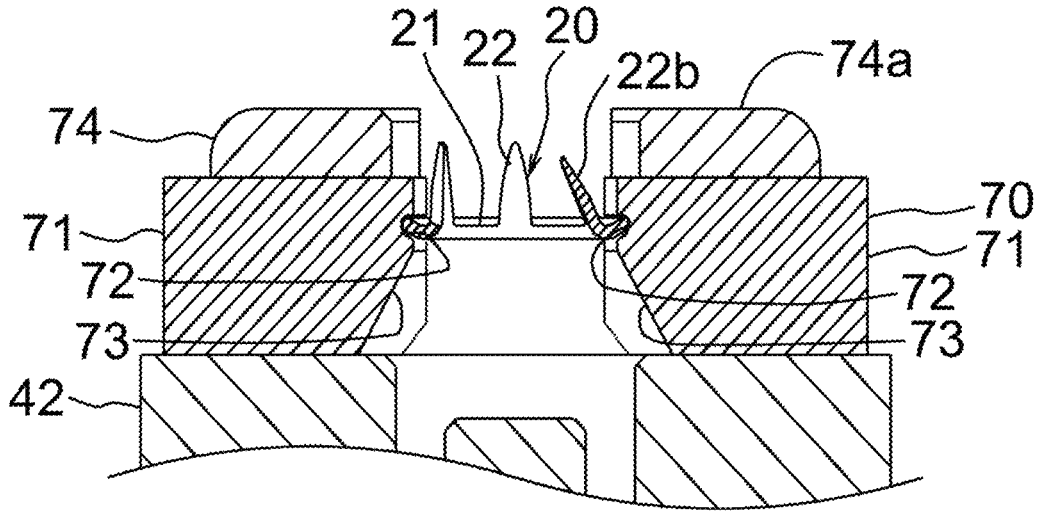
FIG. 6 is a partially enlarged sectional view in the vicinity of the holding part of FIG. 5.

FIG. 6 is an enlarged sectional view in the vicinity of the holding part 70. The holding part 70 includes a pair of left and right (left and right are based on FIGS. 5 and 6, etc.), substantially arc-shaped holding members 71, and an annular elastic member (not shown) for biasing the holding members 71 towards each other. Each of the holding member 71 has, on the side facing each other, a groove 72 for receiving a part of the base 21 of the button fastener 20 and an inclined surface 73 for engaging with the upper end of the supporting member 64 moving upward. Each of the inclined surfaces 73 is inclined so as to gradually expand in diameter downward. On the upper surface of the upper guide 42, a pair of fabric supporting members 74 is also disposed in addition to the holding part 70. Each of the fabric supporting members 74 covers the front, rear and upper sides of each holding member 71 in an almost U-shape, and has a fabric supporting surface 74*a* that is higher than the upper surface of each of the holding members 71.

Figure 13:
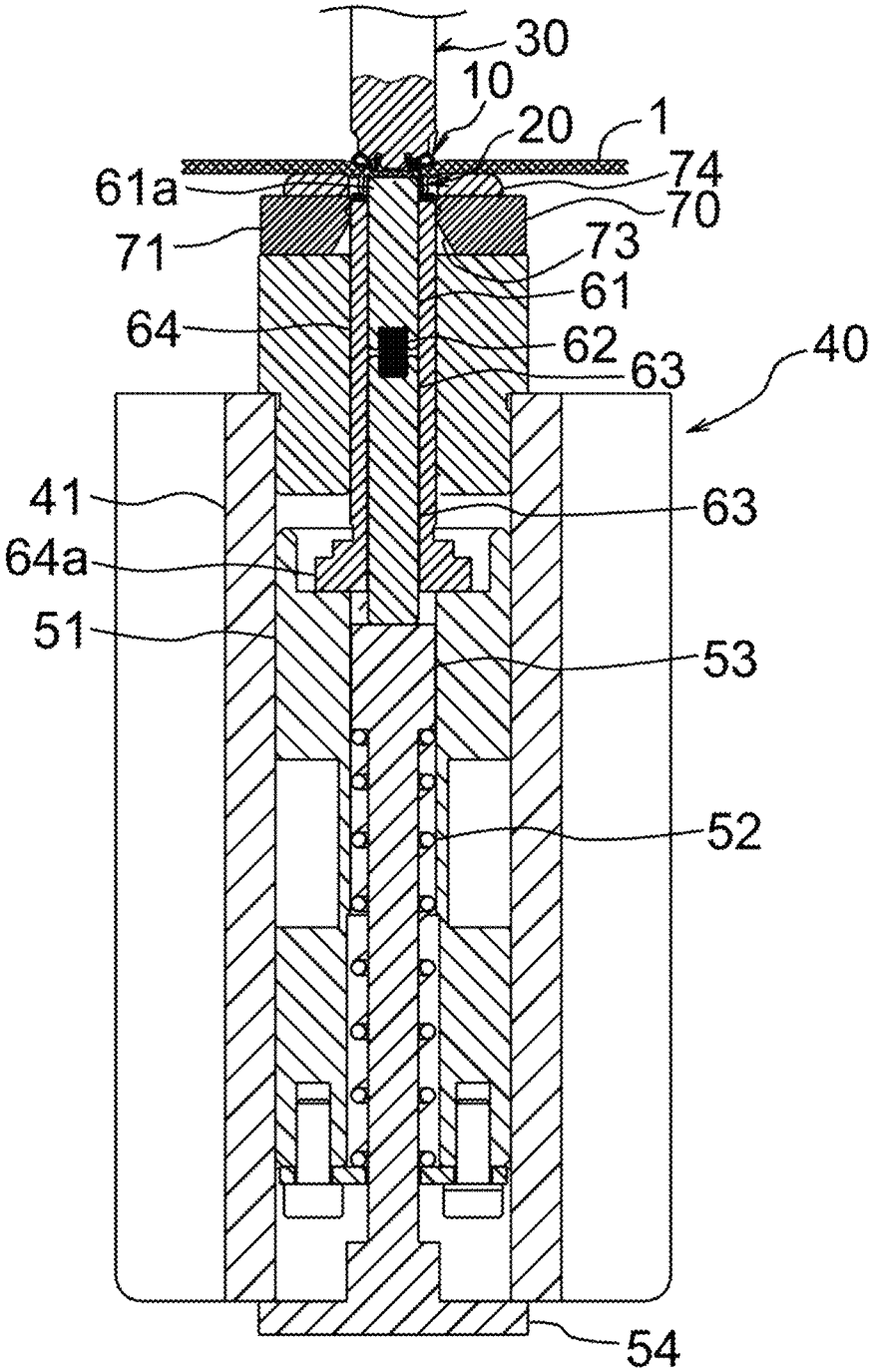
FIG. 13 is a cross-sectional view showing a state where the correcting pin in the uppermost position supports the button fastener immediately before being swaged.

The supporting member 64 has a lower end portion 64*a* with an enlarged outer diameter. The supporting member 64 is lifted up by the plunger 51 of the lower structure body 50 and guided axially upward by the upper guide 42. When the supporting member 64 moves upward, its upper end comes in contact with the inclined surfaces 73 of the pair of the holding members 71 (see FIG. 10). Then, as shown in FIGS. 11 to 13, the upper end of the supporting member 64 continues moving upward while contacting the inclined surfaces 73. Thereby, the upper end of the supporting member 64 causes the pair of the holding members 71 to be displaced away from each other against the biasing of the elastic member. Thereby, the button fastener 20 that was held between the pair of the holding members 71 is released therefrom. Immediately before (or almost simultaneously) the button fastener 20 is released from the holding part 70, the upper end portion 61*a* of the correcting member 61 passes through the opening 23 of the button fastener 20, in which the all legs 22 are in the normal position or one or more legs 22 are in the abnormal position, and then the button fastener 20 is handed over from the holding part 70 to the upper end portion 61*a* of the correcting member 61. The supporting member 64 moves upward to the uppermost position shown in FIG. 13, and in this position the button fastener 20, which is to be swaged against the female snap 10 or the male snap on the upper die 30, is supported on an annular upper end surface of the supporting member 64.

The lower structure body 50 comprises an almost cylindrical plunger 51, which can move upward by being driven by a driving unit not shown; an elongated columnar lower pin 53 as a rear member, which is housed in a columnar lumen of the plunger 51; and a stopper 54 fixed to the lower end of the lower pin 53, the lower end protruding downward from the plunger 51 and the housing frame 41 in the initial position in FIG. 5. The lower pin 53 can move upward by an upward movement of the plunger 51 via a second spring 52. The stopper 54 can restrict an upward movement of the lower pin 53. The outer diameter of an upper end portion 53*a* of the lower pin 53 is larger than the outer diameter of the pushing pin 63 and substantially equal to the outer diameter of the supporting member 64 except for the lower end portion 64*a* thereof. The second spring 52 is arranged on the outer periphery of the lower pin 53. The diameter of the stopper 54 is larger than the inner diameter of the housing frame 41.

The plunger 51 has an upper end surface that supports the bottom surface of the lower end portion 64*a* of the supporting member 64. An annular spring receiving plate 55 that receives the lower end of the second spring 52 is fixed to a lower end surface of the plunger 51 with a plurality of bolts 56. The spring receiving plate 55 has a central hole 55*a* through which the lower pin 53 passes. The diameter of the spring receiving plate 55 is smaller than the inner diameter of the housing frame 41. The upper end of the second spring 52 is received by the lower end of an upper end portion 53*a*, which expands stepwise upward in the lower pin 53.

Next, a process will be described, which is for correcting the leg(s) 22*b* in the abnormal position of the button fastener 20 when the snap button is attached to the fabric 1 using the lower die 40 configured as described above. In the following descriptions, it is assumed that the button fastener 20 has one leg 22*b* in the abnormal position, and this leg 22*b* is referred to as an "abnormal leg 22*b*".

In FIG. 5, the upper and lower structure bodies 60, 50 are in the respective lowermost initial positions, and the button fastener 20 is held by the holding part 70. The plunger 51 can move up and down between the bottom dead center in FIG. 5 and the top dead center in FIG. 13. When the driving unit not shown drives the plunger 51 in the initial position, then the plunger 51 begins to rise. Thereby, as shown in FIG. 7, the plunger 51 causes the supporting member 64 to move upward. In addition, as the plunger 51 rises, the lower pin 53 also begins to rise via the second spring 52. Thereby, the pushing pin 63 is lifted, and the pushing pin 63 pushes the correcting pin 61 upward via the first spring 62. Then, as shown in FIG. 7, the upper end of the correcting pin 61 comes into contact with the abnormal leg 22*b* of the button fastener 20 held by the holding part 70, and therefore the correcting pin 61 receives a resistance and temporarily stops moving upward.

Figure 9:
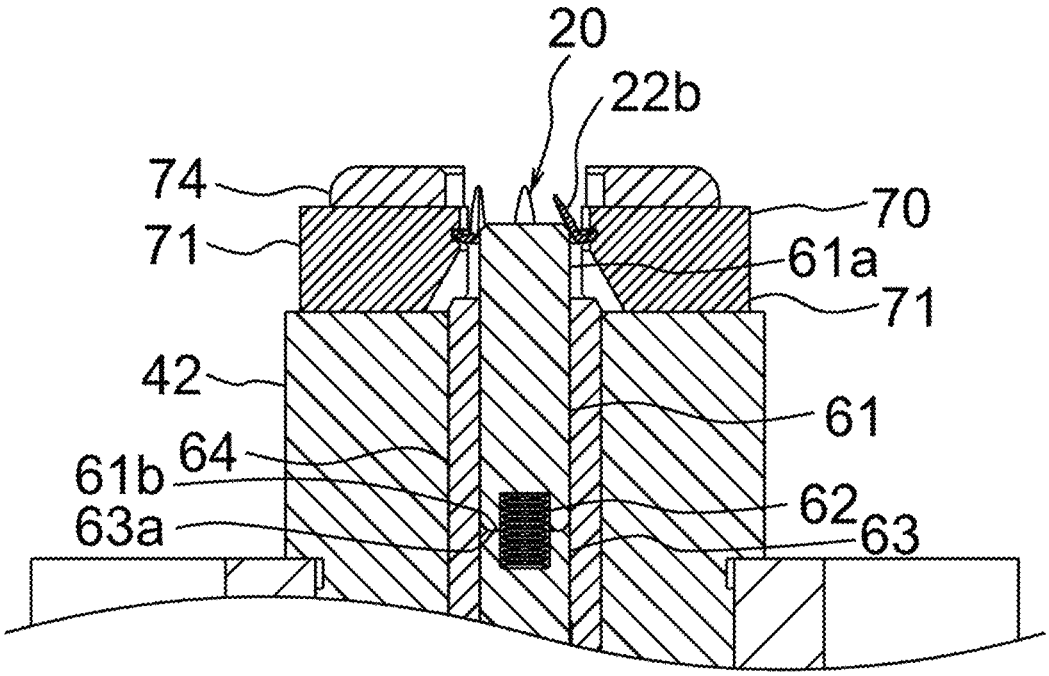
FIG. 9 is a partially enlarged sectional view in the vicinity of the button fastener of FIG. 8.

Even after the correcting pin 61 temporarily stops moving upward, the plunger 51 continues to move upward, and thereby the supporting member 64 continues to move upward and the lifting of the pushing pin 63 by the lower pin 53 also continues. Therefore, the first spring 62 is gradually compressed in the axial direction between the temporarily stopped correcting pin 61 and the ascending pushing pin 63. Then the lower end surface 61*b* of the correcting pin 61 and the upper end surface 63*a* of the pushing pin 63 come in contact with each other and the gap C between them disappears as shown in FIG. 8. FIG. 9 is a partially enlarged view in the vicinity of the button fastener 20 of FIG. 8. With the contact between the correcting pin 61 and the pushing pin 63, the pushing pin 63 continuing moving upward begins to lift the correcting pin 61 directly. Thereby, the correcting pin 61 is forced to move upward, and the upper end portion 61*a* continues to pass through the opening 23 of the button fastener 20 against the resistance from the abnormal leg 22*b* (see FIG. 10). At this time, the upper end portion 61*a* of the correcting pin 61 corrects the abnormal leg 22*b* of the button fastener 20 to be in the normal position (see the leg 22*c*). After the abnormal leg 22*b* is corrected by the upper end portion 61*a* of the correcting pin 61, as shown in FIGS. 10 to 12, the button fastener 20 is lifted up to the uppermost position in FIGS. 11 and 12 by the upper end portion 61*a* due to the friction between the outer peripheral surface of the upper end portion 61*a* and the corrected leg 22*c*. Almost simultaneously with the upper end portion 61*a* of the correcting pin 61 passing through the opening 23 of the button fastener 20, the button fastener 20 is released from the holding of the holding part 70 by the supporting member 64. When all the legs 22 of the button fastener 20 are not in the abnormal position, after the button fastener 20 is released from the holding part 70 by the supporting member 64, the button fastener 20 is put on the upper end surface of the supporting member 64 and then be lifted up by the supporting member 64. FIG. 12 is a partially enlarged view in the vicinity of the button fastener 20 of FIG. 11. The correcting pin 61 is in its uppermost position in FIGS. 11 and 12, and in this position the top 22*a* of each of the legs 22 can contact the fabric 1.

Between the time point of FIG. 10 where the front end portion 61*a* of the correcting pin 61 is passing through the opening 23 of the button fastener 20 and the time point of FIG. 11 where the correcting pin 61 is at its uppermost position, the first spring 62, which was in the compressed state, is restored, and the gap C appears again between the correcting pin 61 and the pushing pin 63. In addition, due to the restoring force of the first spring 62, the rise of the correcting pin 61 from the position of FIG. 10 to the position of FIG. 11 is instantaneously performed. When the button fastener 20 has no abnormal leg 22*b*, the correcting pin 61 is lifted up to the uppermost position without receiving a resistance from the legs 22. In this case, the gap C between the correcting pin 61 and the pushing pin 63 is substantially constant, and the correcting pin 61 moves upward together with the pushing pin 63.

At the time point of FIG. 10 immediately before the correcting pin 61 reaches the uppermost position, the stopper 54 fixed to the lower end of the lower pin 53 comes into contact with the lower end of the housing frame 41, restricting further upward movement of the lower pin 53. Thereby, the pushing pin 63 also stops moving upward. That is, FIG.

10 shows the uppermost position of the pushing pin 63. Immediately after the time point of FIG. 10 where the upward movements of the stopper 54 and the pushing pin 63 have stopped, the correcting pin 61 is raised instantaneously to the uppermost position shown in FIGS. 11 and 12 by the first spring 62 being restored as described above. At this time, in the leg 22*c* corrected to be in the normal position, a radially inward force (spring back) is caused, which makes the leg 22*c* try to return to the abnormal position. With this force, while the button fastener 20 holds the correcting pin 61, the button fastener 20 is raised to its uppermost position together with the correcting pin 61. At this time, the top 22*a* each of the legs 22 of the button fastener 20 is located at substantially the same vertical position as the upper end of the correcting pin 61. The correcting pin 61 comes into contact with the fabric 1 in its uppermost position. The first spring 62 is set so that when the pushing pin 63 is in its uppermost position, the upper end of the correcting pin 61 pushes the fabric 1 with a weak force and contacts the fabric 1. Referring to FIG. 12, the correcting pin 61 contacts the fabric 1 in its uppermost position, and there is no clearance between the correcting pin 61 and the fabric 1. Thereby, it is possible to prevent the leg 22*c* of the button fastener 20 that was corrected to be in the normal position from returning radially inward by the spring back.

Figure 2:
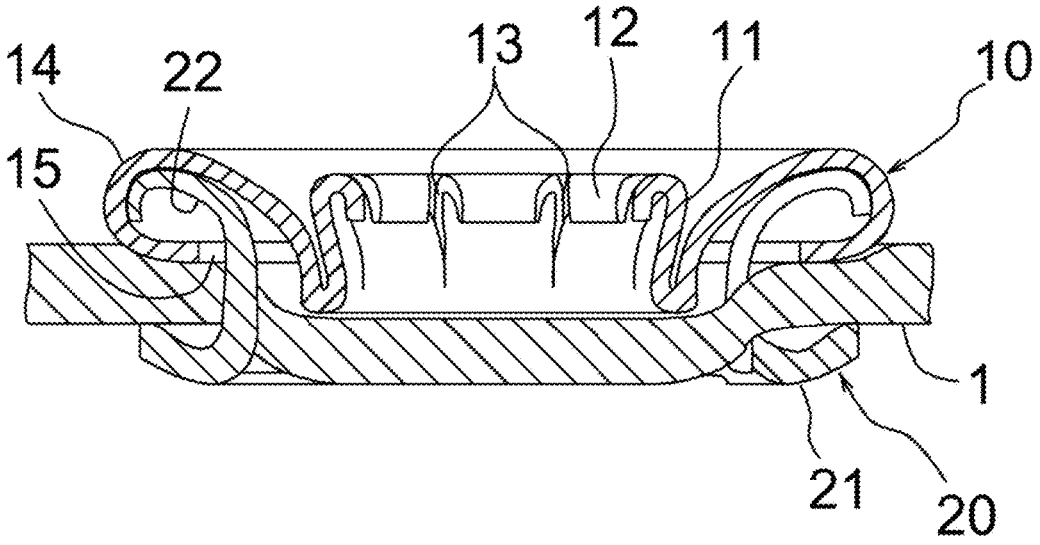
FIG. 2 is a cross-sectional view showing the female snap attached to the fabric with the button fastener.
Figure 3:
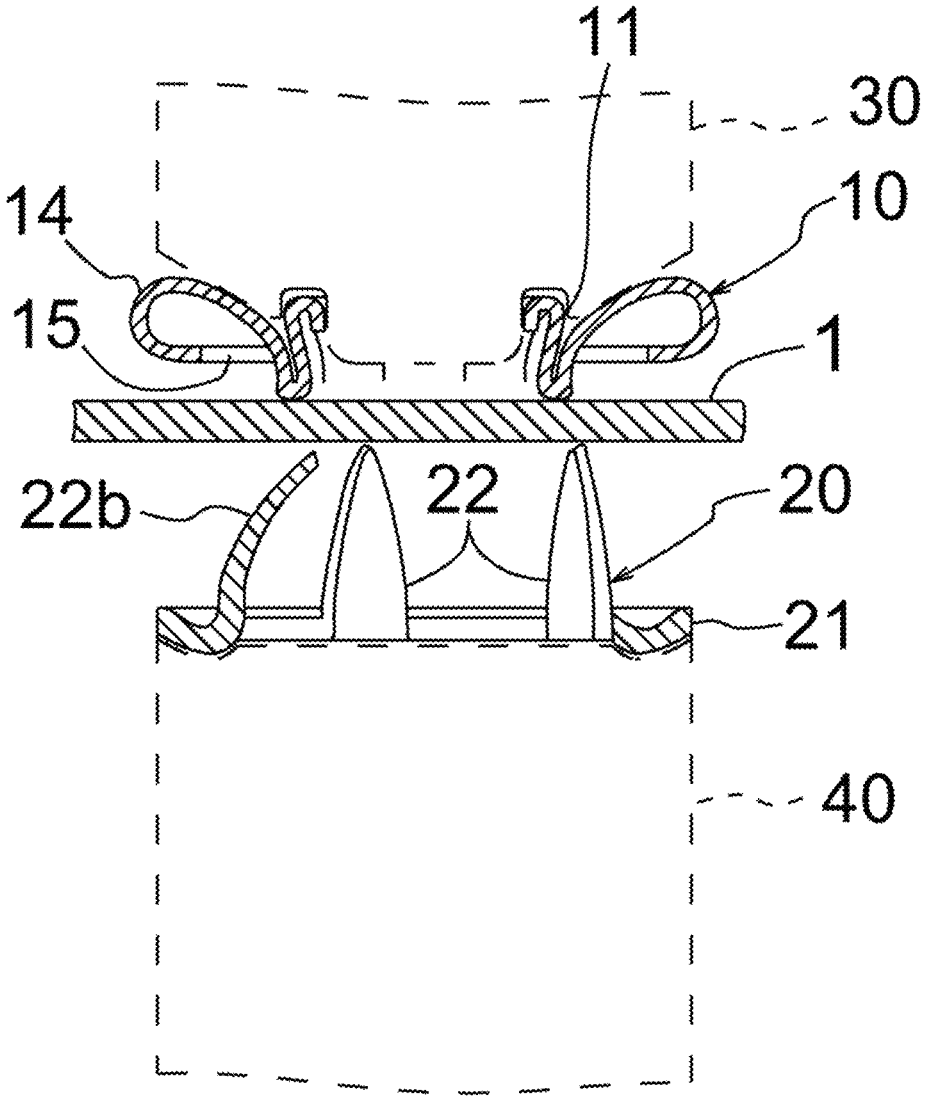
FIG. 3 is a cross-sectional view immediately before the female snap is attached to the fabric with the button fastener, wherein the button fastener has a leg in an abnormal position as bent radially inward from the normal position.
Figure 4:
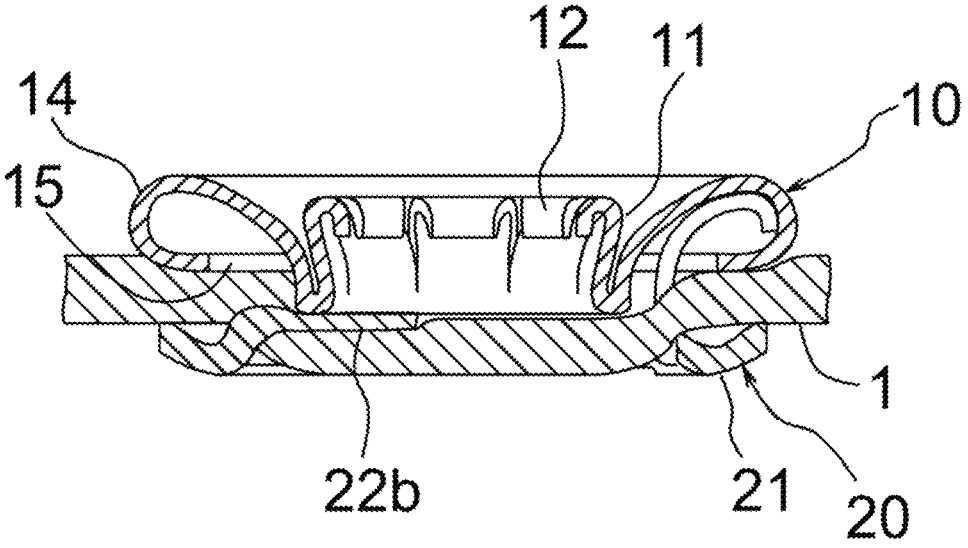
FIG. 4 is a cross-sectional view of a state where the female snap is attached to the fabric with the button fastener shown in FIG. 3.
Figure 14:
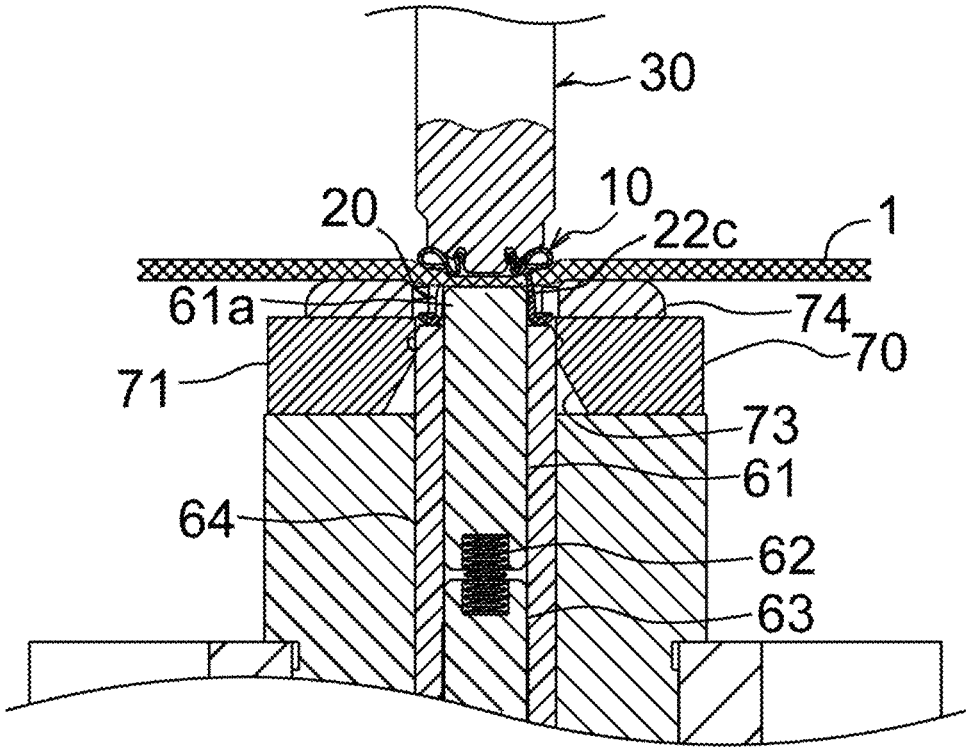
FIG. 14 is a partially enlarged sectional view in the vicinity of the button fastener of FIG. 13.

Even after the stopper 54 contacts the lower end of the housing frame 41, the plunger 51 continues to move upward, whereby the supporting member 64 also continues to move upward. At the time point of FIG. 10, the upper end of the supporting member 64 comes into contact with the inclined surfaces 73 of the pair of the holding members 71. Then, as shown in FIGS. 11 and 12, the supporting member 64 moves upward while contacting the respective inclined surfaces 73. Thereby, the pair of the holding members 71 move away from each other (see FIG. 12) against the biasing of the elastic member (not shown). Thereby, the button fastener 20 is released from the holding of the holding part 70. Once the button fastener 20 is released from the pair of the holding members 71, the button fastener 20 having the leg 22*b* in the abnormal position is received, by friction, on the outer peripheral surface of the upper end portion 61*a* of the correcting pin 61 passing through the opening 23 of the button fastener 20. In a case of the button fastener 20 with no leg 22*b* in the abnormal position, the button fastener 20 is released from the pair of the holding members 71 and then received on the upper end surface of the supporting member 64. After the holding part 70 has released the button fastener 20, the supporting member 64 further moves up to its uppermost position in FIG. 13. FIG. 14 is a partially enlarged view in the vicinity of the button fastener 20 of FIG. 13. Also in FIGS. 13 and 14, a lower part of the upper die 30 holding the female snap 10 is shown. At the time of FIG. 14, the legs 22 (including the leg 22*c*) of the button fastener 20 penetrate the fabric 1 upward and are just before passing through the leg receiving opening 15 of the female snap 10. After this, the legs 22 of the button fastener 20 enter the inside of the flange 14 through the leg receiving opening 15 of the female snap 10 and is swaged along the inner surface of the flange 14 in a curved manner as shown in FIG. 2. At the swaging, although not shown, the correcting pin 61 is pushed downward from the upper die 30 via the female snap 10 and the fabric 1, whereby the first spring 62 is slightly compressed in the axial direction and the pin 63 is pushed downward. Thereby, the second spring 52 is also slightly compressed in the axial direction. By the compressions of the first and second springs 62, 52, it is possible to absorb the load applied to the lower die 40 at the time of swaging.

In the above, a case where the correcting pin 61 temporarily stops moving upward by contacting the abnormal leg 22*b* is described. However, when the radially inward bend of the abnormal leg 22*b* is slight, there may be a case where the upper end portion 61*a* of the correcting member 61 passes, at a somewhat decreased upward moving speed, through the opening 23 of the button fastener 20 without stopping, even though the upper end portion 61*a* contacts the abnormal leg 22*c* and receives a resistance therefrom. In this case, although the first spring 62 may be somewhat compressed in the axial direction, the first spring 62 may not reach the most compressed state where the correcting pin 61 and the pushing pin 63 contact each other. Even in this case, the pushing pin 63 can lift the correcting pin 61 via the first spring 62, and thereby the upper end portion 61*a* of the correcting pin 61 passes through the opening 23 of the button fastener 20, so that the abnormal leg 22*b* is corrected to be in the normal position.

DESCRIPTION OF REFERENCE NUMERALS

10 female snap (snap member)
20 button fastener
21 base
22 leg(s)
22*b* leg(s) in the abnormal position (abnormal leg)
23 opening
30 upper die
40 lower die
41 housing frame
42 upper guide
50 lower structure body
51 plunger
52 second spring
53 lower pin (rear member)
54 stopper
60 upper structure body
61 correcting pin (correcting member)
61*c* upper spring receiving portion (first spring receiving portion)
62 first spring
63 pushing pin (pushing member)
63*b* lower spring receiving portion (second spring receiving portion)
64 supporting member
70 holding part
71 holding member
73 inclined surface
C gap

What is claimed is:

1. A button fastener-side die for attaching a snap button, on which a button fastener is to be set when a snap member is attached to a fabric with the button fastener, the button fastener comprising an annular base defining an opening and a plurality of legs extending from the base, the button fastener-side die comprising:

a holding part for holding the button fastener, an elongated columnar correcting member for passing through the opening of the base of the button fastener held by the holding part, an elongated columnar pushing member for pushing the elongated columnar correcting member to move in a passing direction toward passing through the opening of the base of the button fastener, a first spring disposed between a lower end surface of the elongated columnar correcting member and an upper end surface of the elongated columnar pushing member and arranged to move in the passing direction by the elongated columnar pushing member, and a gap between the lower end surface of the elongated columnar correcting member and the upper end surface of the elongated columnar pushing member, wherein the elongated columnar correcting member, the elongated columnar pushing member, and the first spring have a common axis which is parallel to the passing direction, wherein (i) when at least one of the legs of the button fastener is in an abnormal position bent radially inward from a normal position, the first spring is temporarily compressed and the gap is temporarily reduced from their initial states as the elongated columnar correcting member corrects the leg(s) in the abnormal position to be in the normal position as the elongated columnar correcting member is passing through the opening of the button fastener, (ii) when the legs of the button fastener are not in the abnormal position, the first spring and the gap are substantially kept in their initial states.

2. The button fastener-side die according to claim 1, wherein when the elongated columnar correcting member is in an unloaded state where the elongated columnar correcting member is not subjected to a force in a direction opposite to the passing direction, the first spring is in the initial state.

3. The button fastener-side die according to claim 1, wherein when the elongated columnar correcting member comes into contact with the leg(s) in the abnormal position, the elongated columnar correcting member temporarily stops moving in the passing direction or its moving speed decreases.

4. The button fastener-side die according to claim 3, wherein when the first spring reaches the most compressed state as most compressed in the passing direction, the elongated columnar pushing member pushes the elongated columnar correcting member which is temporarily stopped to force it to move in the passing direction so as to pass through the opening of the button fastener.

5. The button fastener-side die according to claim 4, wherein in the most compressed state of the first spring, the gap disappears and the elongated columnar pushing member comes into contact with the elongated columnar correcting member.

6. The button fastener-side die according to claim 1, comprising a supporting member, which moves in the passing direction in order to release the holding of the button fastener by the holding part and supports the button fastener when the legs of the button fastener are swaged.

7. The button fastener-side die according to claim 6, wherein the supporting member is a cylindrical member, and the elongated columnar correcting member and the elongated columnar pushing member are disposed at least partially inside the supporting member.

8. The button fastener-side die according to claim 6, wherein the holding part comprises a pair of holding members and an elastic member for biasing the pair of the holding members in a direction to approach each other, and wherein each of the holding members has an inclined surface, and the holding members are displaced in a direction away from each other against the biasing of the elastic member by the supporting member contacting the inclined surface.

9. The button fastener-side die according to claim 1, comprising a rear member for moving the elongated columnar pushing member in the passing direction and a stopper for restricting the moving of the rear member in the passing direction at a time when the elongated columnar correcting member can reach the forefront position thereof.

10. The button fastener-side die according to claim 9, comprising a plunger for moving a supporting member in the passing direction.

11. The button fastener-side die according to claim 10, wherein the plunger moves the rear member in the passing direction via a second spring.

12. The button fastener-side die according to claim 1, wherein when the elongated columnar pushing member is in its forefront position in the passing direction, the elongated columnar correcting member reaches its forefront position in the passing direction, by the first spring, where the elongated columnar correcting member is allowed to come into contact with the fabric.

* * * * *